US006772770B1

(12) United States Patent
Williams, Sr.

(10) Patent No.: US 6,772,770 B1
(45) Date of Patent: Aug. 10, 2004

(54) FLOSS TOOTHBRUSH FOR ADULTS AND CHILDREN

(76) Inventor: Alexander Williams, Sr., 1681 NW. 1st Ave., Pompano Beach, FL (US) 33060

( * ) Notice: Subject to any disclaimer, the term of this patent is extended or adjusted under 35 U.S.C. 154(b) by 40 days.

(21) Appl. No.: 10/133,283

(22) Filed: Apr. 26, 2002

(51) Int. Cl.[7] ..... A45D 44/18
(52) U.S. Cl. ..... 132/309; 132/325
(58) Field of Search ..... 433/141; 132/309, 132/311, 321, 323, 324, 325

(56) References Cited

U.S. PATENT DOCUMENTS 736,650 A * 8/1903 Storms, Jr. ..... 132/309
1,537,853 A * 5/1925 Mason ..... 132/309
2,172,591 A * 9/1939 Peterson ..... 132/325
3,861,406 A * 1/1975 Stitt ..... 132/309
4,987,910 A * 1/1991 Lowe ..... 132/309
5,365,956 A * 11/1994 Guadiana ..... 132/309
5,517,712 A * 5/1996 Schiano ..... 15/167.1
5,581,838 A * 12/1996 Rocco ..... 15/110
5,701,921 A * 12/1997 Father et al. ..... 132/309
5,735,298 A * 4/1998 Mayne et al. ..... 132/309
6,039,050 A * 3/2000 Goldenberg ..... 132/309
6,095,157 A * 8/2000 Brown ..... 132/309

* cited by examiner

*Primary Examiner*—Ralph A. Lewis
(74) *Attorney, Agent, or Firm*—Michael I. Kroll

(57) ABSTRACT

A dental device including a combination toothbrush and floss dispenser includes replaceable spools and a pivotable brush portion with bristles on one side and floss posts for positioning floss from the brush portion in a position for flossing.

7 Claims, 11 Drawing Sheets

FLOSS TOOTHBRUSH FOR ADULTS AND CHILDREN

BACKGROUND OF THE INVENTION

Field of the Invention

The present invention relates generally to tooth brush devices and, more specifically, to a tooth brush and floss combination device that is provided in adult and children sizes.

While other tooth brush devices may be suitable for the purposes for which they were designed, they would not be as suitable for the purposes of the present invention, as hereinafter described. What is needed is a device that provides the benefits of having flossing and brushing equipment and material in a single device that readily enables such aspects of dental hygiene.

SUMMARY OF THE PRESENT INVENTION

A primary object of the present invention is to provide a tooth brush and floss combination device that is provided in adult and children sizes.

Another object of the present invention is to provide a tooth brush and floss combination device where the child design consists of bristles that are shorter than that of the conventional tooth brush.

Yet another object of the present invention is to provide a tooth brush and floss combination device that provides a handle portion supporting a housing for a floss spool for dispensing the floss.

Still yet another object of the present invention is to provide a toothbrush and floss combination where the floss is designed to travel through a hole located within a floss spool housing cover and through small posts located on the opposite side of the bristle.

Another object of the present invention is to provide a toothbrush and floss combination where the adult version includes larger size bristles that generally has the same components as the children version.

Yet another object of the present invention is to provide a toothbrush and floss combination with a sanitary, spring-hinged cover which may be opened when replacing the floss spool.

Another object of the present invention is to provide a storage case for the device that can stand upright to allow drainage so as to protect the device when not in use.

Additional objects of the present invention will appear as the description proceeds.

The present invention overcomes the shortcomings of the prior art by providing a tooth brush and floss combination device that is provided in adult and children sizes.

The child design includes bristles that are shorter than that of the conventional adult toothbrush and a handle supporting a housing for a floss spool for dispensing the floss. The floss is designed to travel through a hole located within the spool housing cover and through small posts located on the opposite side from the bristles. The adult version has larger bristles. Both provide a stationary sanitary, spring-hinged spool housing cover that is openable for replacement of the floss spool.

A storage case enclosure is also provided to protect the device when not in use and can stand vertically on its bottom end while allowing fluids to drain.

Both adult and child versions consist of a moveable front bristle portion which can be relocated to either the right or left side of the handle by pivoting. The bristle portion of the device is separate from the handle portion and pivots from right to left on a pivot pin. The bristle portion consists of ridges that couple to channels located within the handle portion. When the ridges and channels are coupled, they stay in place until the user changes the position manually by 'clicking' the bristle portion to a left or right position.

My invention provides a dental device comprising: a floss spool comprising spooled floss; a handle portion having a grasping portion and a spool housing for rotatably supporting the floss spool; and a brush member attached to the handle, the brush member having: a first side, the first side having at least two floss posts to receive and retain a length of floss above the brush member as the floss is spooled from the floss spool, and a second side, the second side having brush bristles.

In one embodiment, the spool housing further comprises a hole for guiding the floss from the spool to one of the floss posts.

In one embodiment, each floss post has a guide hole and a retention slot opening into the guide hole such that the floss can be drawn into and secured by the retention slot after having been threaded through the guide hole.

In one embodiment, the brush portion is pivotably attached to the handle portion.

In one embodiment, the brush portion has a first end, the first end having a hole and at least one elongated ridge aligned with the brush portion; the handle portion has: a slot for receiving the brush portion first end; at least one elongated channel positioned transversely on the handle portion adjacent the slot; at least one elongated channel positioned in alignment with the handle portion adjacent the slot; and a hole for aligning with the received brush portion first end hole; the device further comprises a pin for insertion into such aligned holes, the brush portion pivoting about the pin such that the at least one brush portion first end aligned ridge mates with the handle portion at least one aligned channel when the brush portion is aligned with the handle portion, and first such that the at least one brush portion first end aligned ridge mates with the at least one handle portion transverse channel when the brush portion is pivoted to be transverse to the handle portion.

In one embodiment, the brush portion first end has a top side, the top side having a first one of the brush portion first end aligned ridges, and a bottom side, the bottom side having a second one of the brush portion first end aligned ridges; a first one of the handle portion aligned channels mates with the first one of the brush portion first end aligned ridges, and a second one of the handle portion aligned channels mates with the second one of the brush portion first end aligned ridges, when the handle portion is aligned with the brush portion; and a first one of the handle portion transverse channels mates with the first one of the brush portion first end aligned ridges, and a second one of the handle portion transverse channels mates with the second one of the brush portion first end aligned ridges, when the brush portion is pivoted to a transverse position with respect to the handle portion.

In one embodiment, the brush portion has a first and second transverse ridge that align with the first and second handle portion transverse channels when the brush portion is aligned with the handle portion.

In one embodiment, the brush portion pivots approximately 90 degrees in each of two directions from the aligned position with the handle portion.

In one embodiment, the device further comprises an enclosure for storing the device, the enclosure having a first and second portion, the first and second portions being removably attached, the first portion bottom adapted for supporting the enclosure in an upright position, the first portion bottom end having a hole for draining the enclosure.

There is provided a dental device comprising: a floss spool comprising spooled floss; a handle portion having a grasping portion and means for rotatably supporting the floss spool; and a brush member attached to the handle, the brush member having: a first side, the first side having means for receiving and retaining a length of floss above the brush member as the floss is spooled from the floss spool, and a second side, the second side having brush bristles.

In one embodiment, the spool housing further comprises means for guiding the floss from the spool to the means for receiving and retaining.

In one embodiment, the device further comprises means for pivoting tie brush portion with respect to the handle portion.

In one embodiment, the device further comprises means for storing the device upright and means for draining the means for storing.

A dental device is provided comprising: a floss spool comprising spooled floss; a handle portion having a grasping portion and a spool housing for rotatably supporting the floss spool, the spool housing further comprising a hole for guiding the floss from the spool to one of the floss posts; and a brush member pivotably attached to the handle, the brush member having: a first side, the first side having at least two floss posts to receive and retain a length of floss above the brush member as the floss is spooled from the floss spool, each floss post having a guide hole and a retention slot opening into the guide hole such that the floss can be drawn into and secured by the retention slot after having been threaded through the guide hole; and a second side, the second side having brush bristles; and further wherein: the brush portion has a first end, the first end having a hole and at least one elongated ridge aligned with the brush portion; and the handle portion has: a slot for receiving the brush portion first end; at least one elongated channel positioned transversely on the handle portion adjacent the slot; at least one elongated channel positioned in alignment with the handle portion adjacent the slot; and a hole for aligning with the received brush portion first end hole; the device further comprising a pin for insertion into such aligned holes, the brush portion pivoting about the pin such that the at least one brush portion first end aligned ridge mates with the handle portion at least one aligned channel when the brush portion is aligned with the handle portion, and flier such that the at least one brush portion first end aligned ridge mates with the at least one handle portion transverse channel when the brush portion is pivoted to be transverse to the handle portion.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which:

FIG. 1 is an illustrative view of prior art. Getting children to brush and floss can be a difficult task. The child has to deal with too many items needed to complete a total cleaning and sometimes loses interest in what they are doing. The device of the present invention overcomes the problem of past tooth cleaning equipment by providing a combined tooth brush and dental floss device. The device is provided in children and adult sizes.

Figure 5:
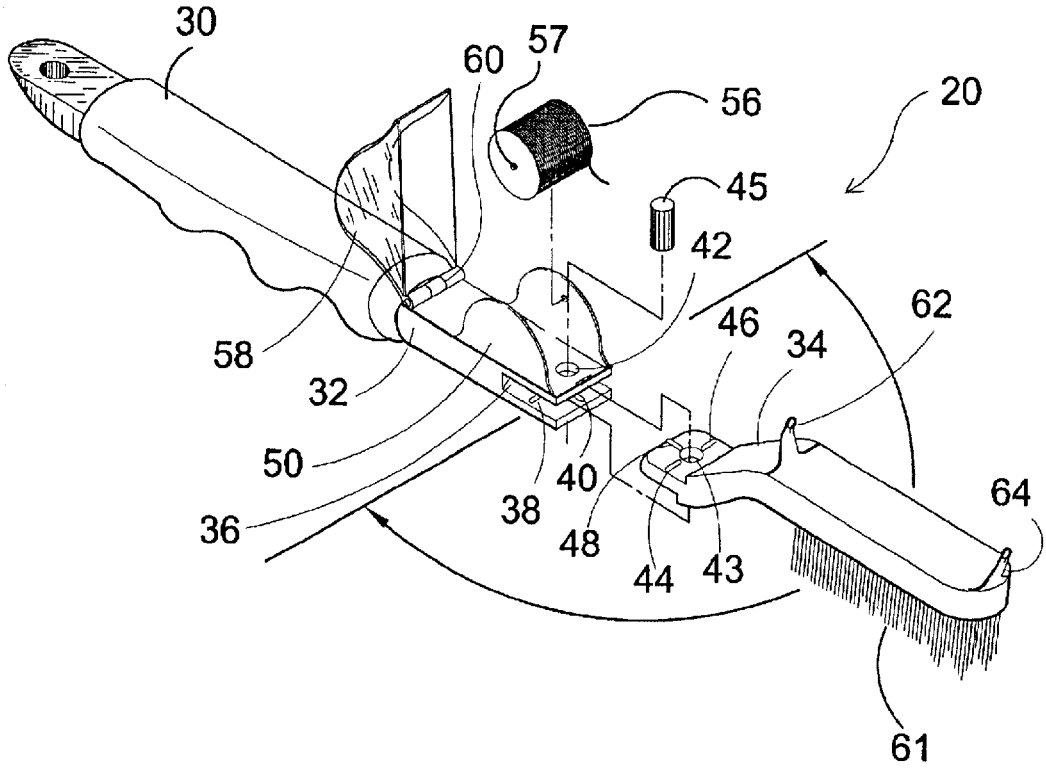

FIG. 5 is a perspective view of the present invention with the spool housing cover shown open and the floss spool removed from the housing. The floss spring hinge cover is a sanitary protection cover for protection of the dental floss therein. The cover is openable for the replacement of the dental floss spool. The bristlebrush portion of the device is pivotable on the handle portion and rotates right and left on a pivot pin. The bristle portion includes ridges that couple to channels located within the handle portion. When the ridges and channels are coupled, they stay in place until the user changes the position of the bristle portion by clicking to a new position.

Figure 6:
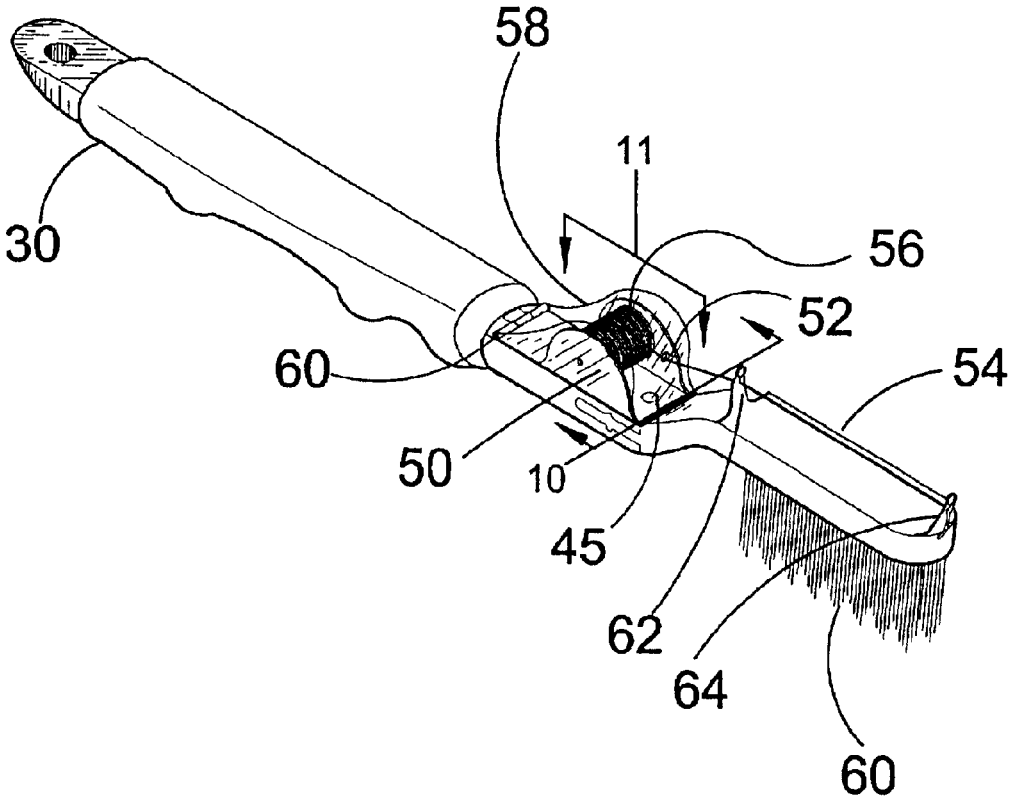

FIG. 6 is a perspective view of the adult version of the present invention.

Figure 7:
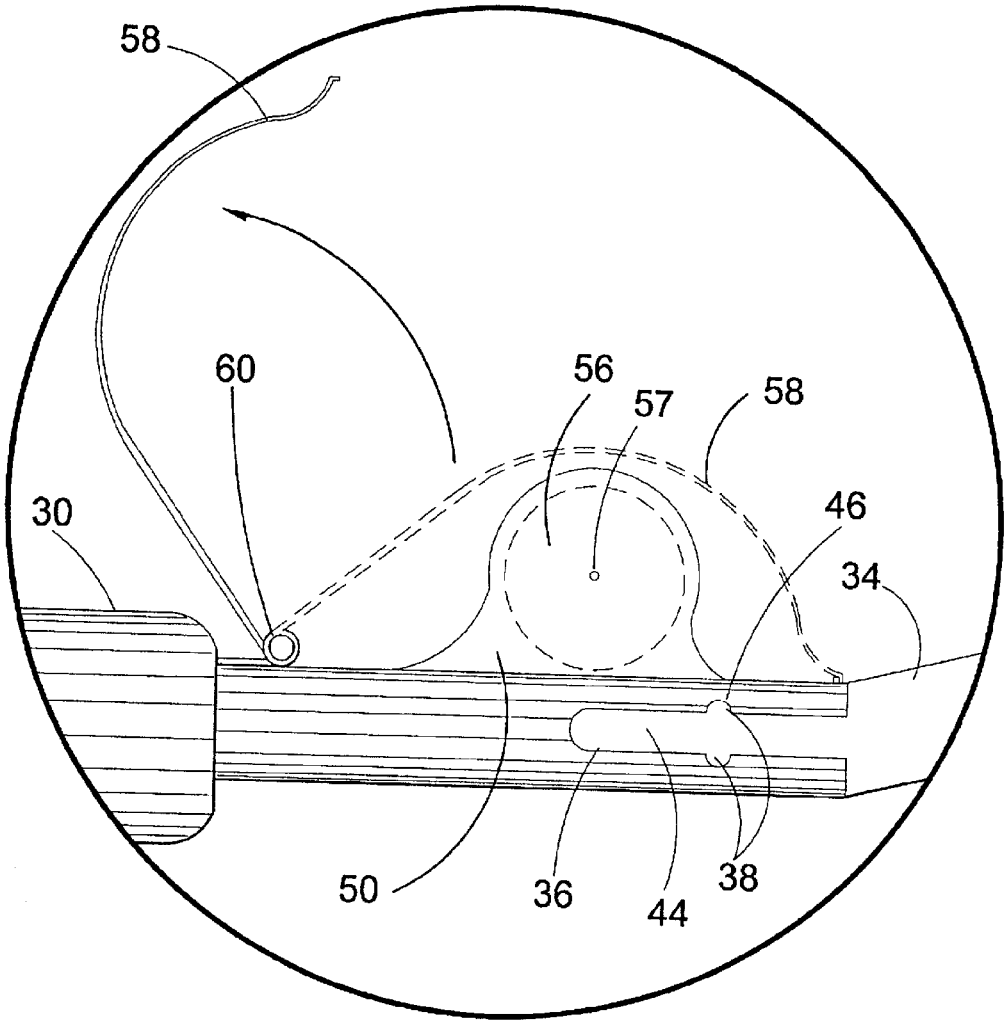

FIG. 7 is a detail view of the adult version of the present invention with the hinged spool housing floss cover in the open position.

Figure 8:
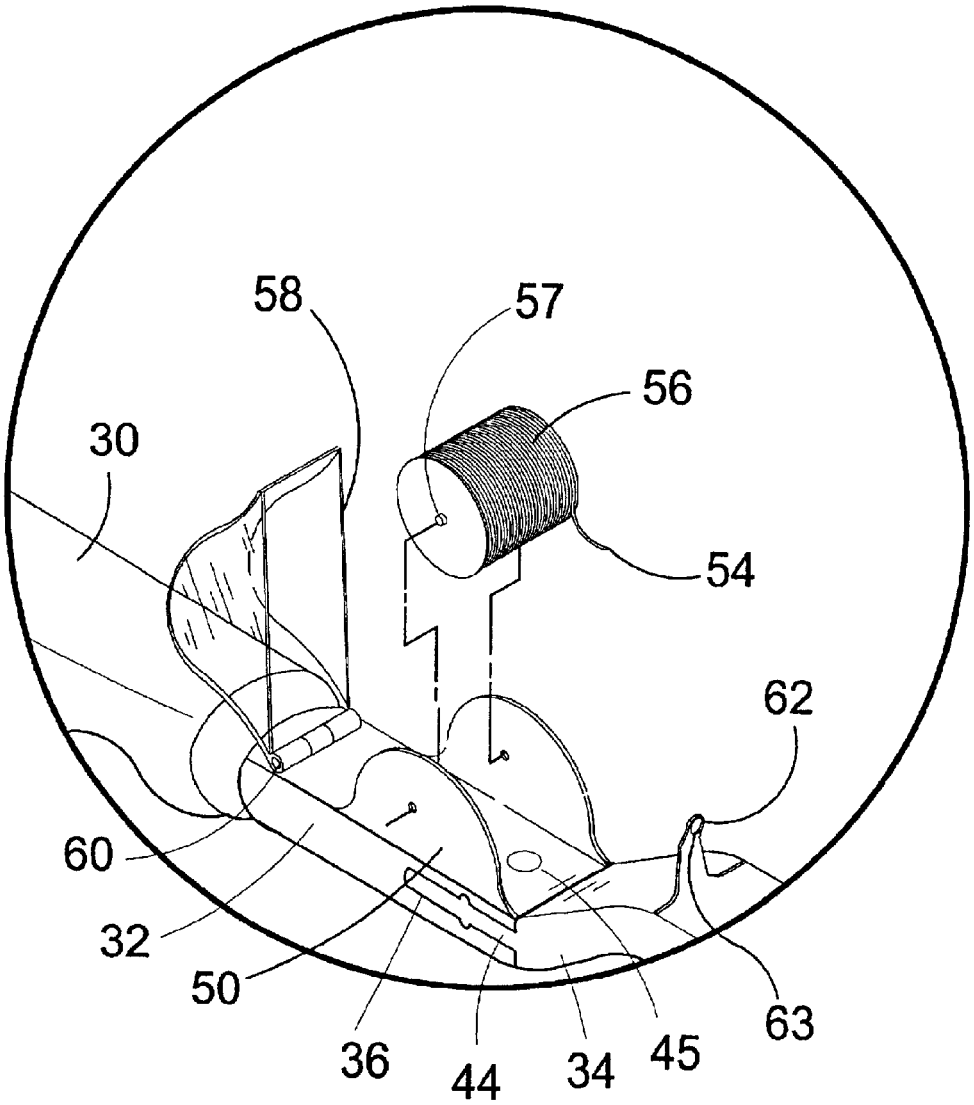

FIG. 8 is a detail view of the adult version of the present invention.

Figure 9:
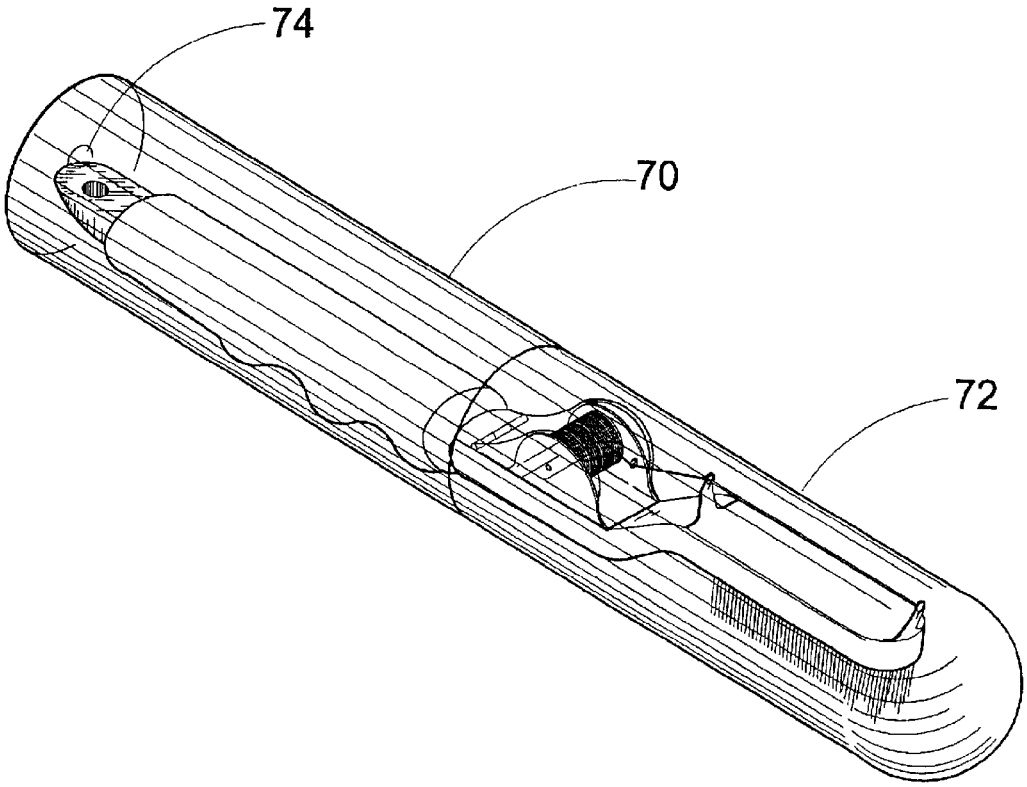

FIG. 9 is a perspective view of the present invention with sanitary storage case that is designed to stand upright to allow drainage of water through a hole located at the bottom of the storage case.

Figure 10:
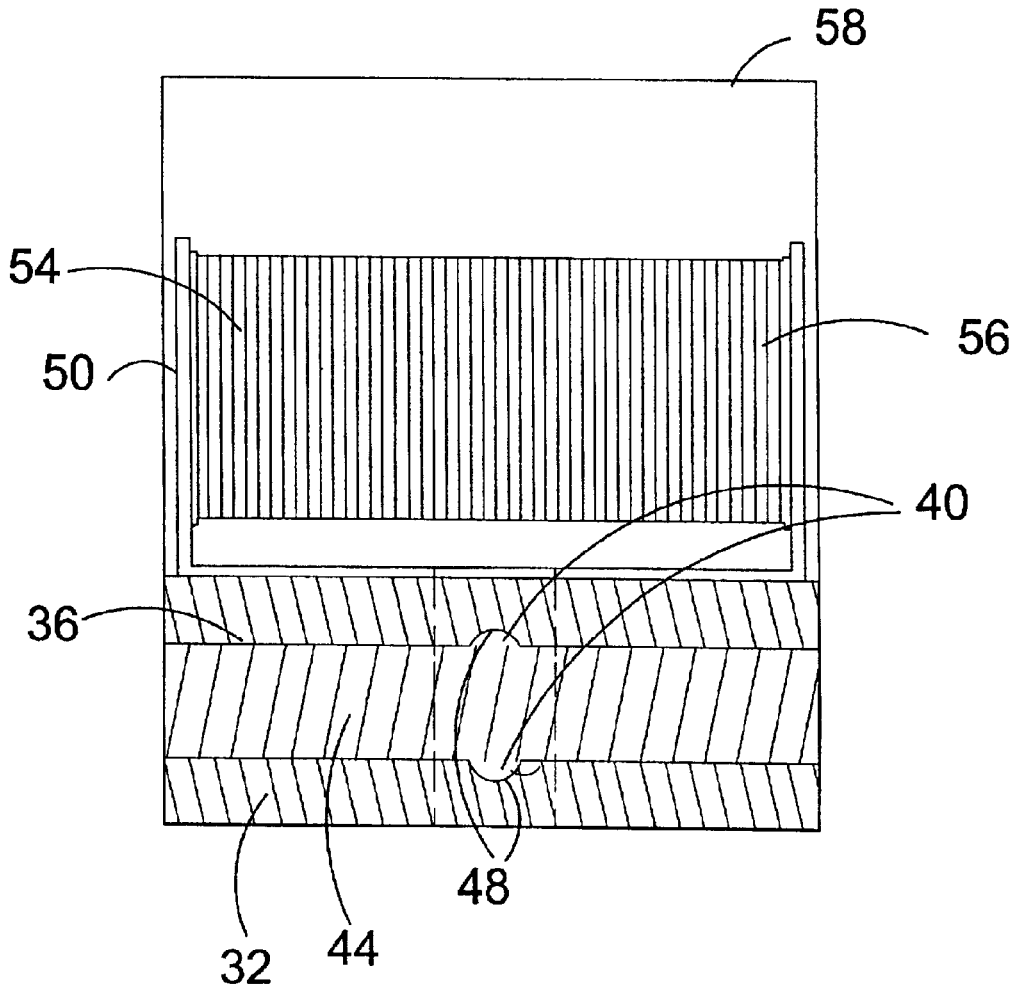

FIG. 10 is a sectional view of the present invention. FIG. 10 shows a sectional view as cut from FIG. 6 showing channels and ridges.

Figure 11:
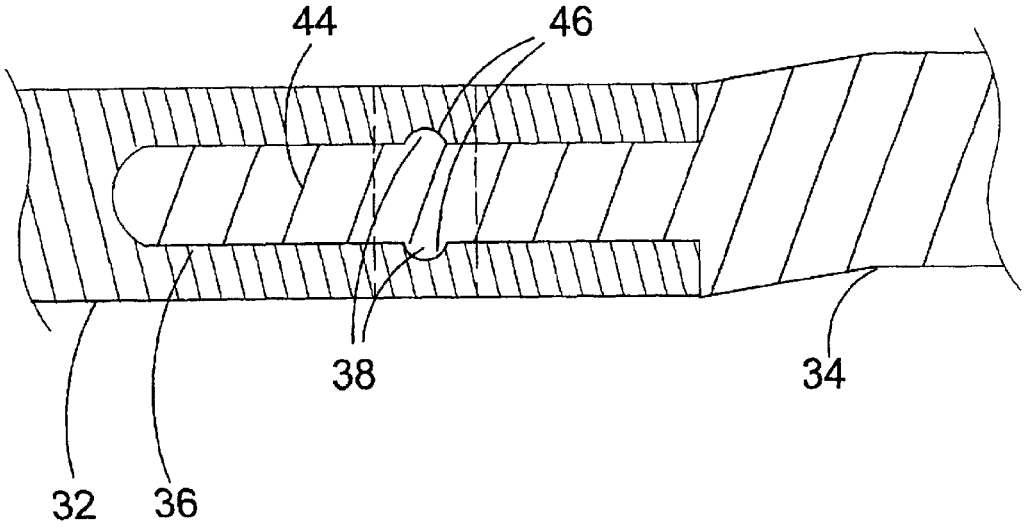

FIG. 11 is a sectional view of the present invention. FIG. 11 shows a sectional view as cut from FIG. 6 showing the channels and ridges.

DESCRIPTION OF THE REFERENCED NUMERALS

Turning now descriptively to the drawings, in which similar reference characters denote similar elements throughout the several views, the figures illustrate exemplary embodiments of the present invention. With regard to the reference numerals used, the following numbering is used throughout the various drawing figures.

20 Exemplary embodiment of the present invention
21 user
22 user hand

23 user mouth
24 user teeth
25 prior art floss and container
30 handle portion
32 handle portion spool housing base
34 brush portion
36 handle portion slot
38 handle portion transverse channel
40 handle portion aligned channel
42 handle portion hole
43 brush portion first end hole
44 brush portion first end
45 pivot pin
46 brush portion transverse ridge
48 brush portion aligned ridge
50 spool housing
52 housing cover hole
54 exposed floss
56 floss spool
57 floss spool pins
58 housing cover
60 housing cover spring hinge
61 brush bristles
62 first floss post
63 first floss post guide hole-retention slot
64 second floss post
65 second floss post guide hole-retention slot
70 enclosure first portion
72 enclosure second portion
74 enclosure drain hole

DETAILED DESCRIPTION OF EXEMPLARY EMBODIMENTS OF THE INVENTION

The following discussion describes in detail exemplary embodiments of the present invention. This discussion should not be construed, however, as limiting the invention to those particular embodiments. Practitioners skilled in the art will recognize numerous other embodiments as well. For a definition of the complete scope of the invention, the reader is directed to the appended claims.

Figure 1:
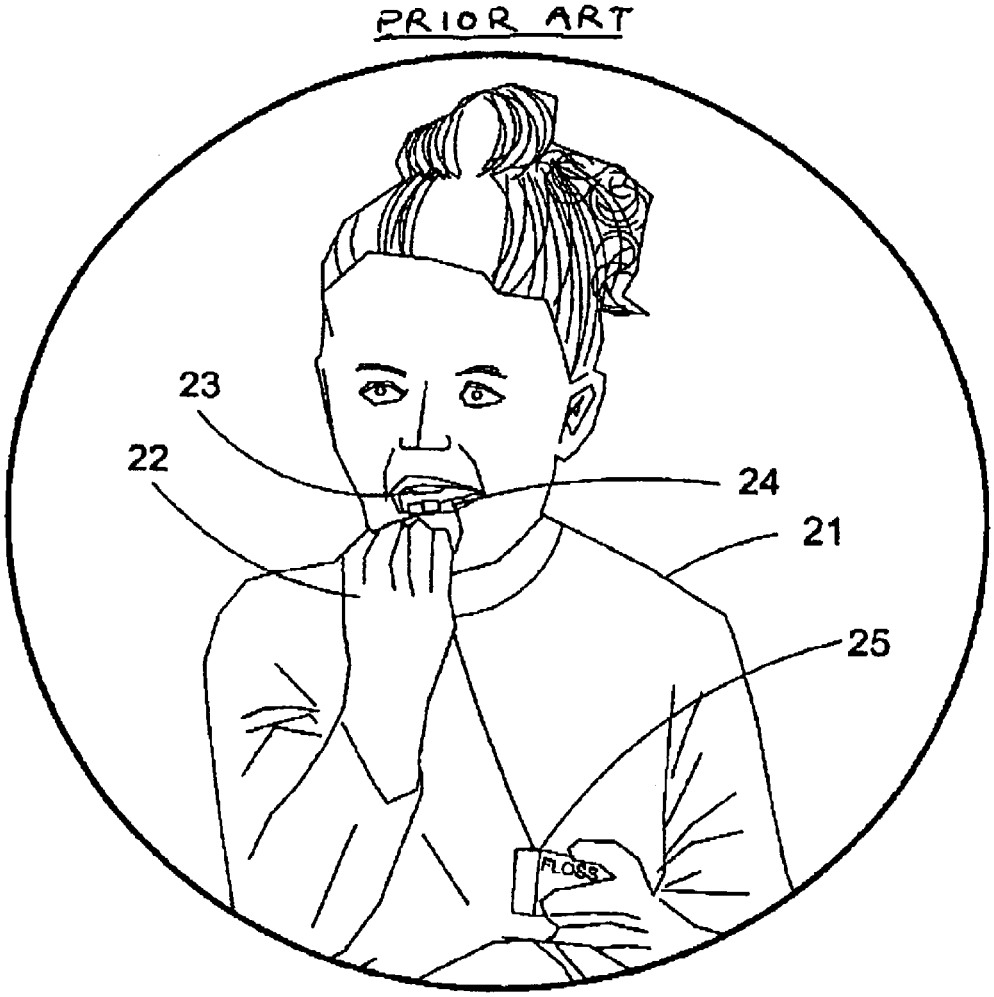

FIG. 1 illustrates the use of a floss container in the prior art by a child user 21 using her hand 22 to run the floss 25 to her mouth 23 and trough her teeth 24.

Figure 2:
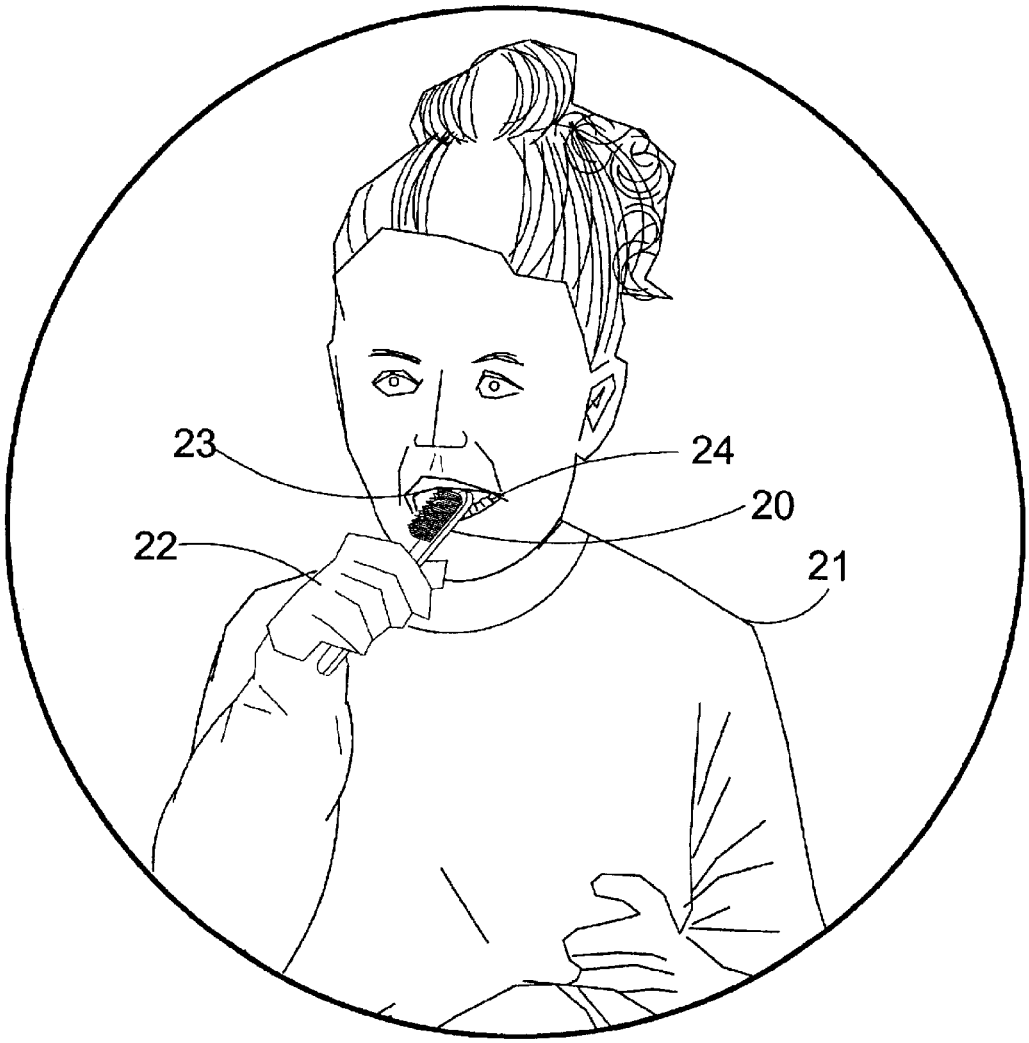
FIG. 2 is an illustrative view of the present invention. The device of the present invention, a tooth brush and floss combination, that is provided in adult and children sizes.
Figure 3:
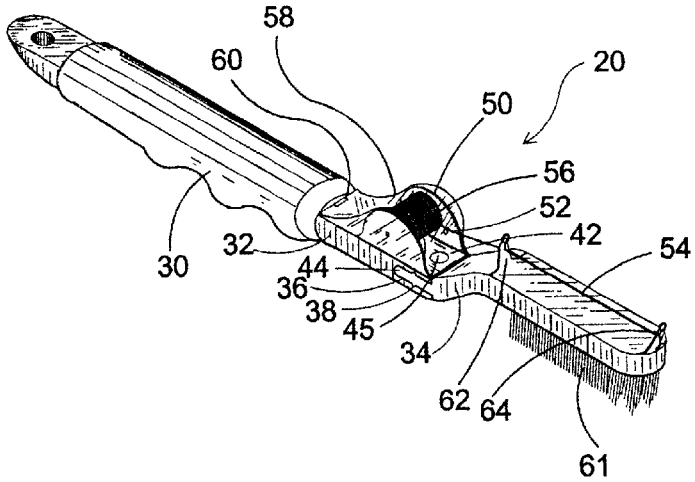
FIG. 3 is a detail view of the present invention.

Turning now to FIG. 2 an exemplary embodiment of the device 20 is shown in use as a flossing device. The exemplary embodiment of the device 20 is shown FIGS. 3–11 to comprise a handle portion 30, a handle portion spool housing base 32, and a brush portion 34. The handle portion has a slot 36 with an upper and lower transverse channel 38 and an upper and lower aligned channel (reference 40 on FIG. 5). The handle portion also has a hole (reference 42 on FIG. 5).

As shown in FIG. 5, the brush portion 34 has a first end 44 with a hole 43 that aligns with the handle portion hole 42 to receive a pivot pin 45. The brush portion pivots about the pin with respect to the handle portion slot.

The brush portion has an upper and lower transverse ridge 46 and an upper and lower aligned ridge 48. As shown in FIG. 10, when the pivot pin 45 attaches the brush portion first end 44 within the handle portion slot 36, the brush portion aligned ridges 48 mate with the handle portion aligned channels 40 to position the brush portion in alignment with the handle portion, i.e. the longitudinal axes of the handle portion and the brush portion are aligned. Also in such a position, the brush portion transverse ridges 46 align with the handle portion transverse channels 38, as shown in FIG. 11.

The ridge dimensions are such that this aligned position is maintained firmly, but not rigidly. When a concentrated force, easily achievable by small hands, is applied in a manner to rotate the brush portion about the pivot pin, the aligned ridges disengage from the aligned channels and the brush portion can be pivoted approximately 90 degrees in either direction until the brush portion aligned ridges 48 mate with the handle portion transverse channels 38. This positions the brush portion transversely to the handle portion, at an approximately 90 degree angle. Similarly, this pivoting disengages the brush portion transverse ridges 46 from the handle portion transverse channels 38 for new mating with the handle portion aligned channels 40.

Figure 4:
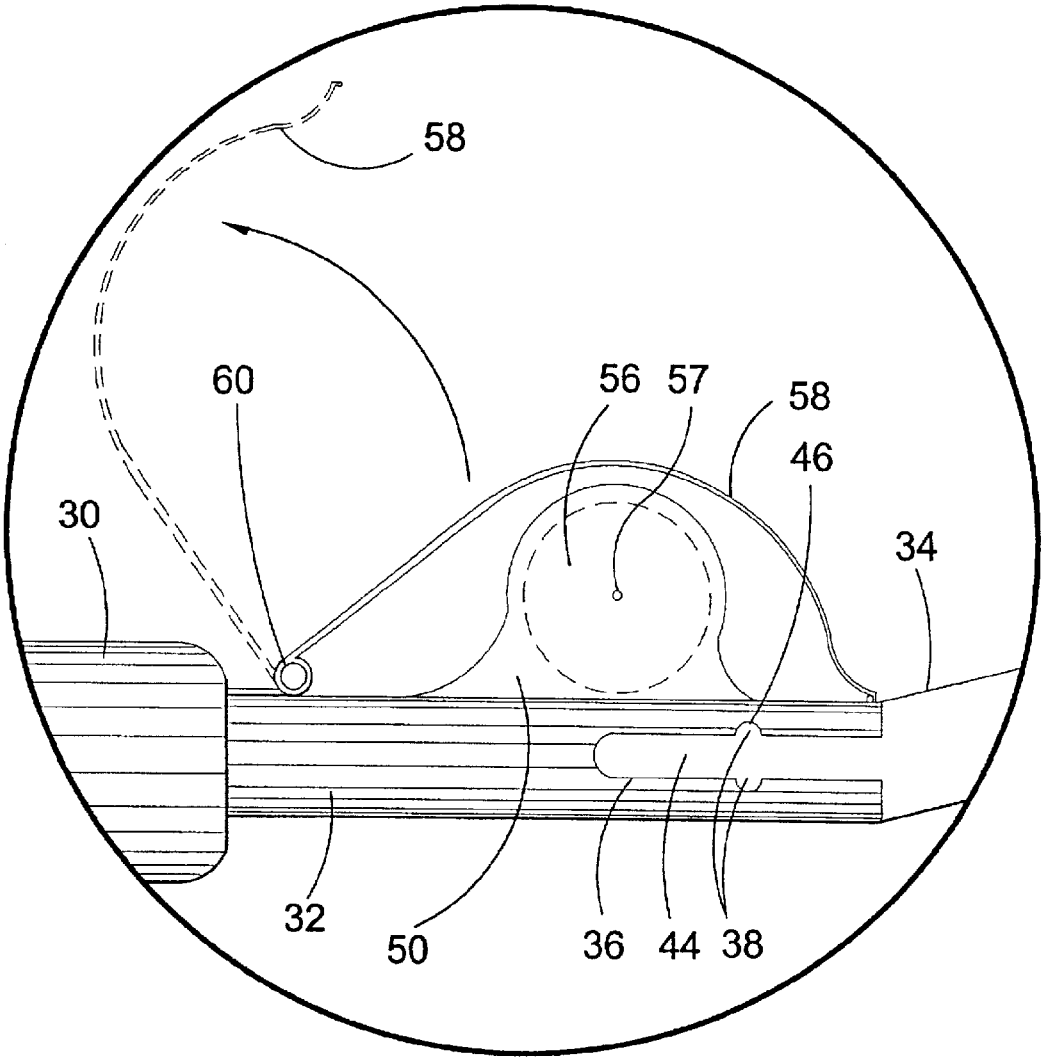
FIG. 4 is a detail view of the present invention showing the hinged spool housing cover in the closed position.

As shown in FIG. 4, FIG. 7, and FIG. 8, a spool housing 50 rotatably holds a floss spool 56 by the spool pins 57 and is protected by a spool housing cover 58 that is attached by a spring hinge 60 that biases the housing cover against the handle portion spool housing base 32. The housing cover is shown closed in FIG. 4 and open in FIG. 7.

As shown in FIG. 6, the housing cover has a guide hole 52 through which the floss 54 is threaded. As the floss exits through the guide hole it is then easily threaded within the first floss post 62 using the floss post guide hole-retention slot 63, and then within the second floss post 64 using the second floss post guide hole-retention slot 65.

Once the floss has been so threaded it is retained and tightened by pulling the floss into the retention slots 63,65 on the first and second floss posts 62,64. In such a position the floss is elevated a sufficient height to accommodate the typical user's teeth. In this regard, child size and adult size embodiments are provided for both large and small teeth.

The brush portion 34 has brush bristles 61 on the side opposite from the floss posts 62,64. Various bristle patterns, sizes, and stiffness are provided in various embodiments. By simply repositioning the device in the user's hand 22 the bristles are positioned to function in conventional toothbrush fashion.

As shown in FIG. 9, a storage enclosure has a first portion 70 and a second portion 72 that are removably attached to completely enclose the device. The first portion has a flat bottom 76 with a drain hole 74, such that the enclosure stands upright to drain any residual liquids from the enclosure.

With respect to the above description then, it is to be realized that the optimum material and dimensional relationships for the parts of the device 20, will include variations in size, materials, shape, and form, which will occur to those skilled in the art upon review of the present disclosure. For example, the device is constructed, in various embodiments, from various plastics, metals and woods.

All equivalent relationships to those illustrated in the drawings and described in the specification are intended to be encompassed by the present invention.

What is claimed as new and desired to be protected by letters patent is set forth in the appended claims:

1. A dental device comprising:

a floss spool comprising spooled floss;

a handle portion having a grasping portion and a spool housing for rotatably supporting the floss spool; and a brush cordon pivotally attached to the handle, the brush portion having:

a first side, the first side having at least two floss posts to receive and retain a length of floss above the brush portion as the floss is spooled from the floss spool, and a second side, the second side having brush bristles;

the brush portion has a first end, the first end having a hole and at least one elongated ride aligned with the brush portion;

the handle portion has:

a slot for receiving the brush portion fist end;

at least one elongated channel positioned transversely on the handle portion adjacent the slot;

at least one elongated channel positioned in alignment with the handle portion adjacent the slot; and a hole for aligning with the received brush portion first end hole;

the device further comprising a pin for insertion into such aligned holes, the brush portion pivoting about the pin such that the at least one brush portion first end aligned ridge mates with the handle portion at least one aligned channel when the brush portion is aligned with the handle portion, and further such that the at least one brush portion fist end aligned ridge mates with the at least one handle portion transverse channel when the brush portion is pivoted to be transverse to the handle portion.

2. The device of claim 1 wherein the spool housing further comprises a hole for guiding the floss from the spool to one of the floss posts.

3. The device of claim 1 wherein each floss post has a guide hole and a retention slot opening into the guide hole such that the floss can be drawn into and secured by the retention slot after having been threaded through the guide hole.

4. The device of claim 1 wherein:

the bush portion first end has a top side, the top side having a first one of the brush portion first end aligned ridges, and a bottom side, the bottom side having a second one of the brush portion first end aligned ridges;

a first one of the handle portion aligned channels mates with the first one of the brush portion first end aligned ridges, and a second one of the handle portion aligned channels mates with the second one of the brush portion first end aligned ridges, when the handle portion is aligned with the brush portion; and a first one of the handle portion transverse channels mates with the first one of the brush portion first end aligned ridges, and a second one of the handle portion transverse channels mates with the second one of the brush portion first end aligned ridges, when the brush portion is pivoted to a transverse position with respect to the handle portion.

5. The device of claim 1 wherein the brush portion pivots approximately 90 degrees in each of two directions from the aligned position with the handle portion.

6. The device of claim 1 after comprising an enclosure for storing the device, the enclosure having a first and second portion, the first and second portions being removably attached, the first portion bottom adapted for supporting the enclosure in an upright position, the fist portion bottom end having a hole for draining the enclosure.

7. A dental device comprising:

a floss spool comprising spooled floss;

a handle portion having a grasping portion and a spool housing for rotatably supporting the floss spool, the spool housing further comprising a hole for guiding the floss from the spool to one of the floss posts; and a brush member pivotably attached to the handle, the brush member having:

a first side, the first side having at least two floss posts to receive and retain a length of floss above the brush member as the floss is spooled from the floss spool, each floss post having a guide hole and a retention slot long into the guide hole such that the floss can be drawn into and secured by the retention slot after having been threaded through the guide hole; and a second side, the second side having brush bristles;

and further wherein:

brush portion has a first end, the first end having a hole and at least one elongated ridge aligned with the brush portion; and the handle portion has:

a slot for receiving the brush portion first end;

at least one elongated channel positioned transversely on the handle portion adjacent the slot;

at least one elongated channel positioned in alignment with the handle portion adjacent the slot; and a hole for aligning with the received brush portion first end hole;

the device further comprising a pin for insertion into such aligned holes, the brush portion pivoting about the pin such that the at least one brush portion first end aligned ridgemates with the handle portion at least one aligned channel when the brush portion is aligned with the handle portion, and further such that the at least one brush portion first end aligned ridge mates with the at least one handle portion transverse channel when the brush portion is pivoted to be transverse to the handle portion.

* * * * *